US005626208A

United States Patent [19]

Sprague et al.

[11] Patent Number: 5,626,208

[45] Date of Patent: May 6, 1997

[54] LIFT ASSEMBLY

[76] Inventors: Randy L. Sprague, 4088 Washington, Piedmont, Okla. 73078; Lyndall G. Bodkin, Rte. 1, Box 253, Cashion, Okla. 73016

[21] Appl. No.: 501,916

[22] Filed: Jul. 13, 1995

[51] Int. Cl.[6] ..... B66B 9/02

[52] U.S. Cl. ..... 187/267; 187/268

[58] Field of Search ..... 187/267, 268, 187/401, 406, 408, 223, 224, 210

[56] References Cited

U.S. PATENT DOCUMENTS

| | | | |
|---|---|---|---|
| 1,986,620 | 1/1935 | Borden et al. | 187/267 |
| 2,148,932 | 2/1939 | Fisher | 187/267 X |
| 2,737,709 | 3/1956 | Lovelace | 187/267 X |
| 3,392,959 | 7/1968 | Lewis | 187/267 X |
| 4,557,353 | 12/1985 | Pichon | 187/401 X |
| 5,311,970 | 5/1994 | Basta | 187/408 X |
| 5,339,704 | 8/1994 | Lindberg | 187/268 X |

*Primary Examiner*—D. Glenn Dayoan
*Assistant Examiner*—Richard A. Chandler
*Attorney, Agent, or Firm*—Dunlap & Codding, P.C.

[57] ABSTRACT

A lift assembly adapted to be incorporated into a structure for moving an object between adjacent floors of a structure. The lift assembly including a guide rail vertically extending between the adjacent floors, a traveler assembly slidingly disposed on the guide rail, a carrier assembly connected to the traveler assembly for holding the object to be moved, and a drive assembly cooperatively connected to the traveler assembly to cause the traveler assembly to move in an upward direction and a downward direction along the guide rail.

12 Claims, 6 Drawing Sheets

LIFT ASSEMBLY

BACKGROUND OF THE INVENTION

1. Field of the Invention

The present invention relates generally to elevators or lifting devices, and more particularly, but not by way of limitation, to an improved lift assembly for moving an object between adjacent floors of a structure.

2. Brief Description of Related Art

Most residential houses are provided with a space immediately below the roof of the house commonly known as an attic which is primarily used for storage. Access to the attic is usually gained through a small, rectangular opening provided in the ceiling which is accessible via a folding ladder extendible from the attic to the floor immediately below the attic.

The problem with the use of such an arrangement is that the typical ladder and opening combination is usually not well suited to accommodate an individual who is attempting to place an object in the attic or remove an object from the attic. That is, the awkward arrangement of the ladder and the opening make it difficult for an individual to keep his balance when climbing the ladder with an object in his arms. Furthermore, it is difficult for an individual to maintain his balance when attempting to place an object through the opening, particularly if the object to be stored is rather large and heavy.

Because of the awkwardness of the ladder and the opening, objects are often damaged as a result of dropping the objects from the ladder. Still worse, however, injuries often arise as a result of individuals losing their balance and falling off the ladder or falling through the ceiling.

To this end, a need has long existed for an improved lift assembly for moving items between adjacent floors of a structure which is easily incorporated into the structure and simple to operate. It is to such a lift assembly that the present invention is directed.

BRIEF DESCRIPTION OF THE DRAWINGS

FIG. 6 is a circuit diagram for a drive control used in the present invention.

DETAILED DESCRIPTION

Figure 1:
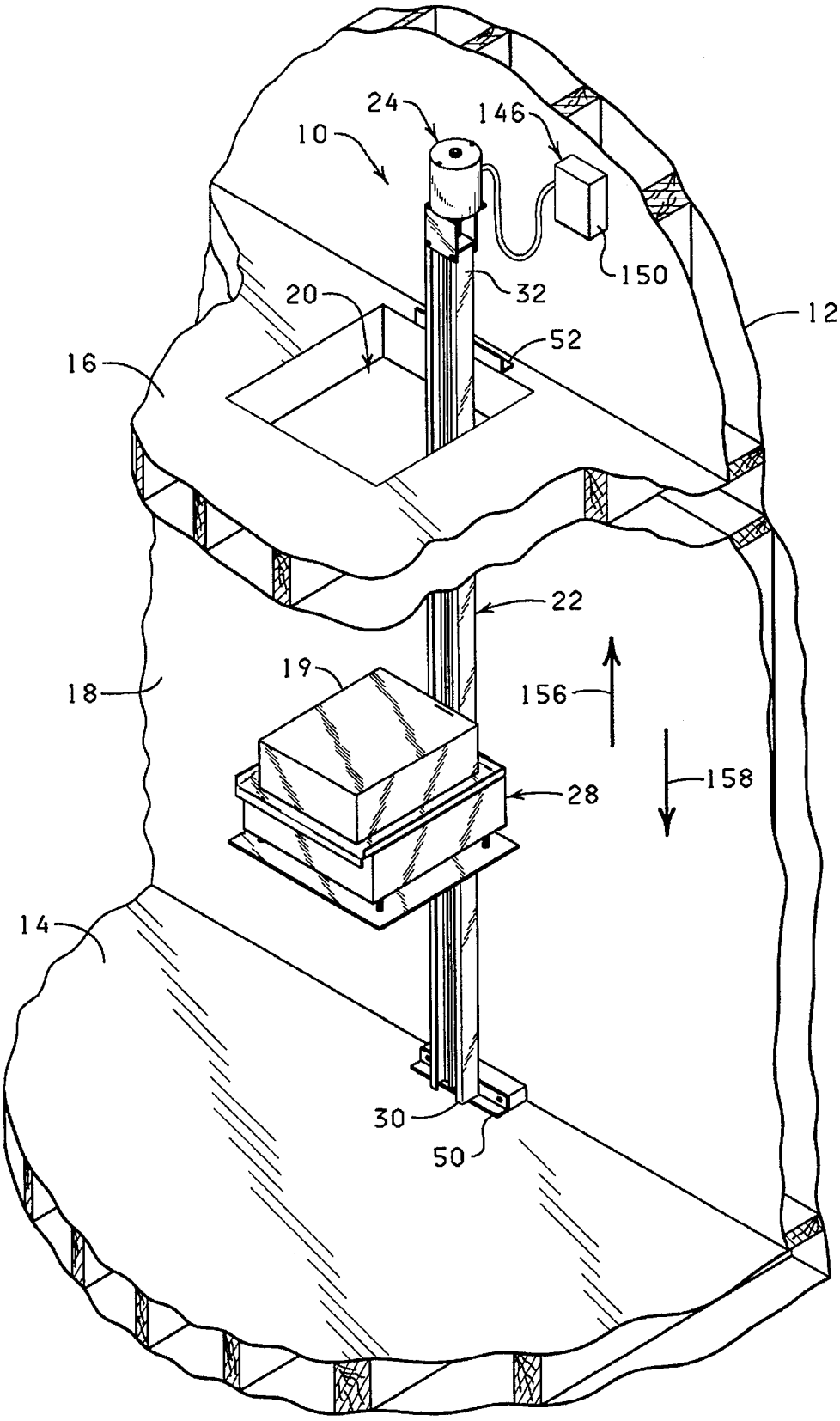
FIG. 1 is a partially cut away, perspective view of a structure having a lift assembly constructed in accordance with the present invention incorporated therein.

Referring now to the drawings and more particularly to FIG. 1, a lift assembly 10 constructed in accordance with the present invention is shown mounted to a structure 12, such as a house or building. The structure 12 includes a first floor 14, a second floor 16, and a side wall 18. The lift assembly 10 is adapted to mechanically move an object 19, such as a box for example, between a first vertical position, such as the first floor 14, and a second vertical position, such as the second floor 16. The structure 12 is modified to accommodate the lift assembly 10 by providing an opening 20 through the second floor 16 dimensioned to receive the lift assembly 10 in a manner described in greater detail below. Broadly, the lift assembly 10 includes a guide rail 22, a drive assembly 24, a traveler assembly 26 (FIG. 3), and a carrier assembly 28.

Figure 2:
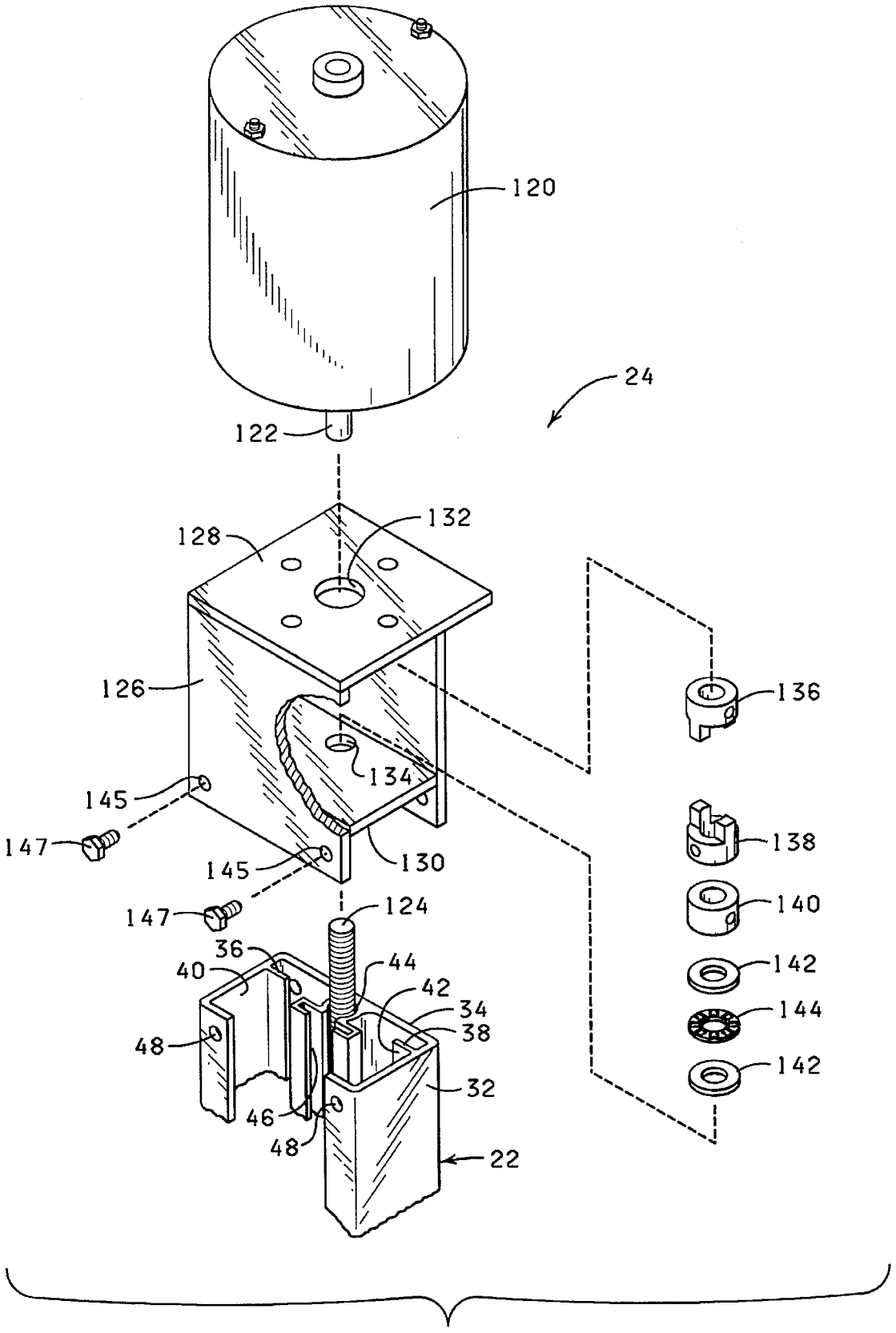
FIG. 2 is an exploded view of a drive assembly of the present invention.

Referring now to FIGS. 1 and 2, the guide rail 22 has a first end 30 and a second end 32 and is dimensioned such that the second end 32 extends a distance above the second floor 16 when the guide rail 22 is vertically extended with the first end 30 of the guide rail 22 positioned near the first floor 14. The guide rail 22 has a generally C-shaped exterior wall 34. Portions of the exterior wall cooperate with a pair of inwardly extending members 36 and 38 to define a pair of wheel guides 40 and 42, respectively, extending from the first end 30 to the second end 32 of the guide rail 22.

The guide rail 22 is further formed to have a screw receiving bore 44 and a traveler slot 46 extending between the first end 30 and the second end 32 of the guide rail 22. The traveler slot 46 is in open communication with the bore 44 along the length thereof, as best illustrated in FIG. 2.

The guide rail 22 is provided with a plurality of holes 48 near the second end 32 thereof for connecting the drive assembly 24 to the guide rail 22 in a manner to be described below. The guide rail 22 is mounted to the sidewall 18 or a portion of the first floor 14 and the second floor 16 of the structure 12 with a pair of mounting brackets 50 and 52 in a conventional manner.

Figure 3:
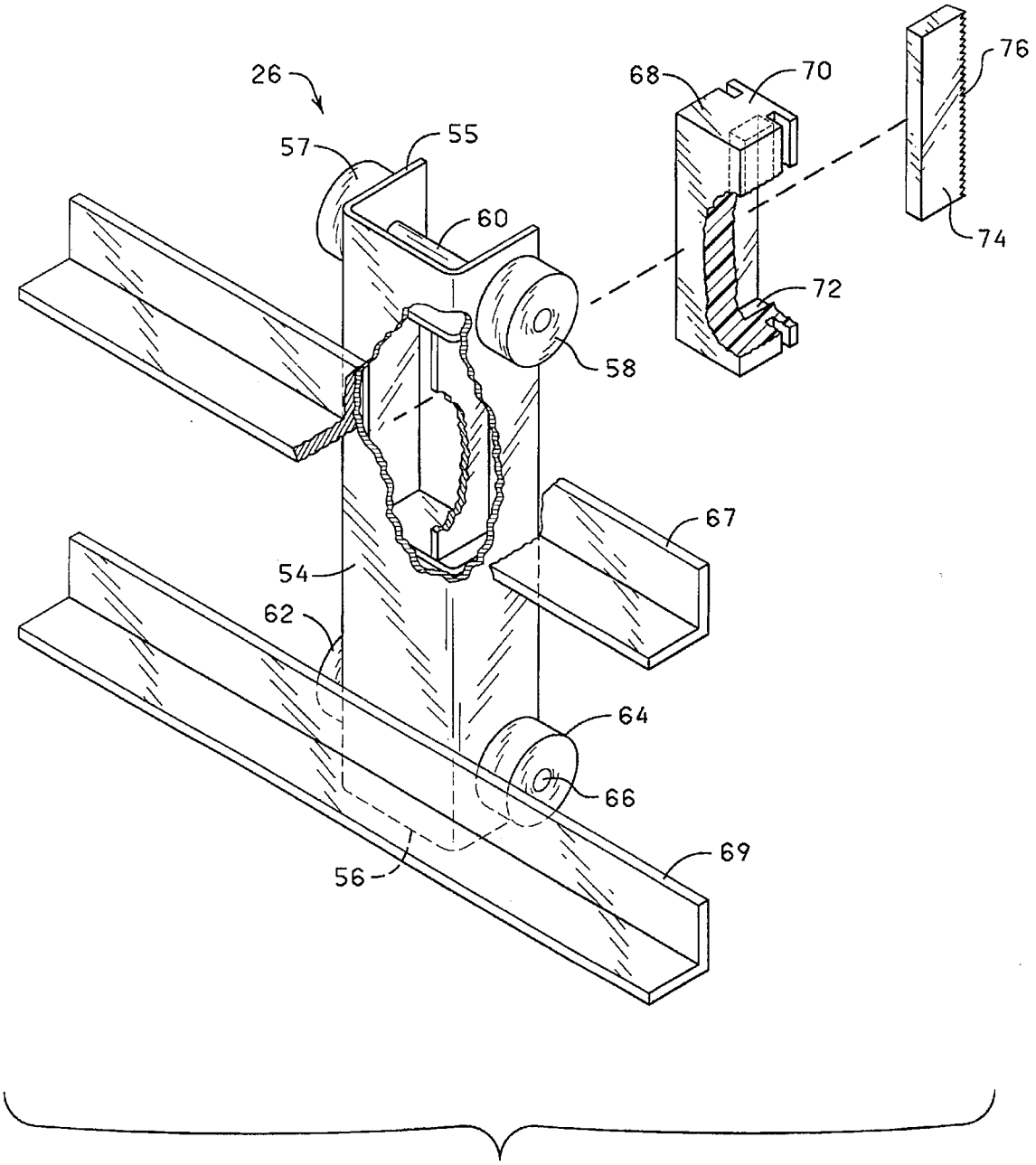
FIG. 3 is an exploded view of a traveler assembly of the present invention.
Figure 4:
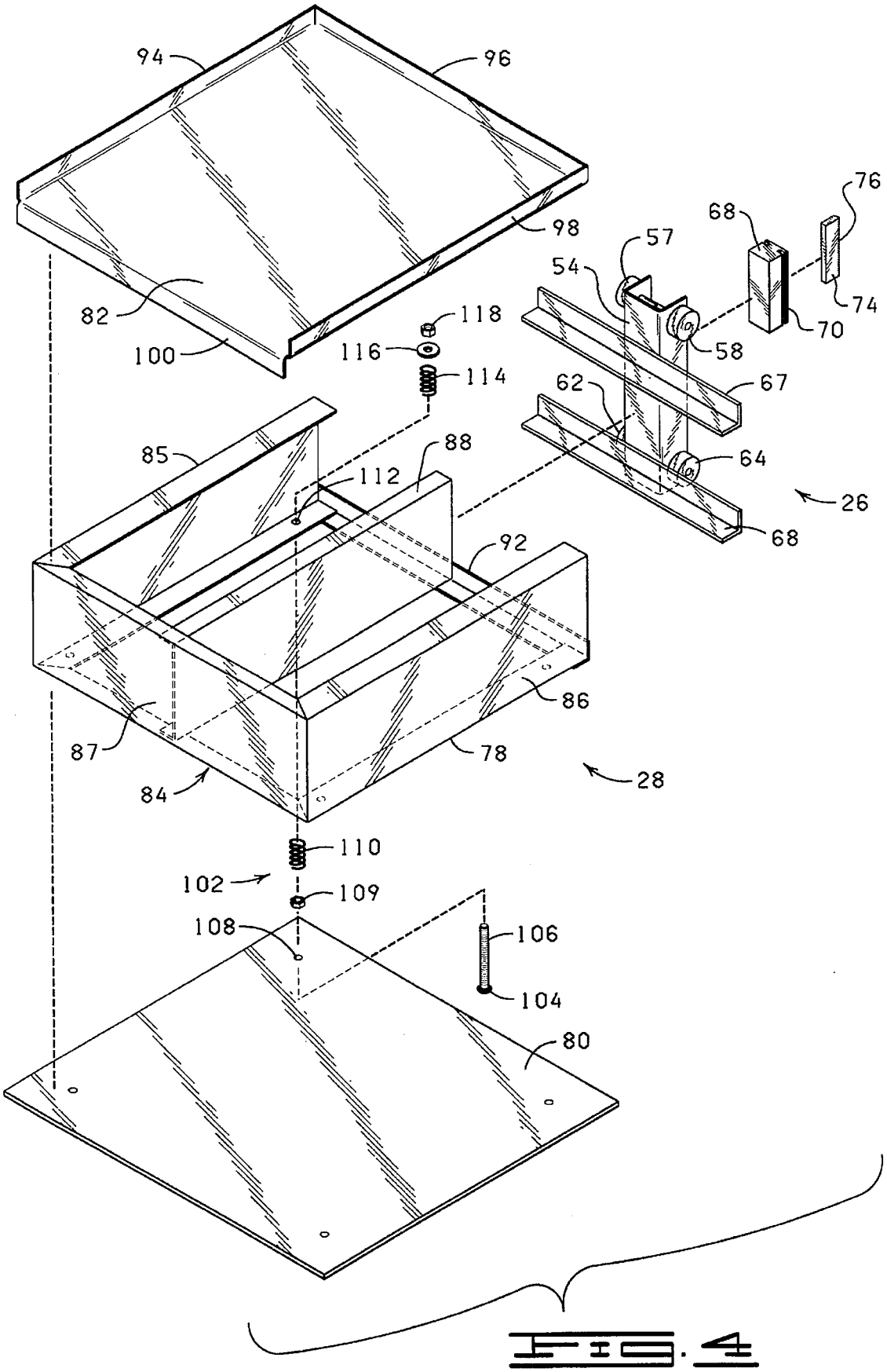
FIG. 4 is an exploded view of a carrier assembly and the traveler assembly.

FIG. 3 is an exploded view of the traveler assembly 26 and FIG. 4 is an exploded view of the traveler assembly 26 and the carrier assembly 28. The traveler assembly 26 includes a U-shaped body member 54 having a first end 55 and a second end 56. A pair of wheels 57 and 58, sized to be rollingly disposed in the wheel guides 40 and 42 of the guide rail 22, is rotatably connected to the body member 54 near the first end 55 thereof via an axle 60. Similarly, a second pair of wheels 62 and 64, sized to be rollingly disposed in the wheel guides 40 and 42 of the guide rail 22, is connected to the body member 54 near the second end 56 thereof via an axle 66. A pair of brackets 67 and 69 are connected to the body member 54 substantially as shown for connecting the carrier assembly 28 to the traveler assembly 26.

The traveler assembly 26 further includes a guide block 68 connected to the body member 54 between the axle 60 and the axle 66. The guide block 68 has a traveler guide portion 70 adapted to be slidingly disposed in the traveler slot 46 of the guide rail 22. The guide block 68 is provided with a recess 72 (FIG. 4) dimensioned to receive a gear block 74 which has a threaded edge 76. The threaded edge 76 of the gear block 74 is matingly engageable with the drive assembly 24 so as to cause the traveler assembly 26 to move up and down the guide rail 22 when the drive assembly is operated in a manner described in detail below.

Figure 5:
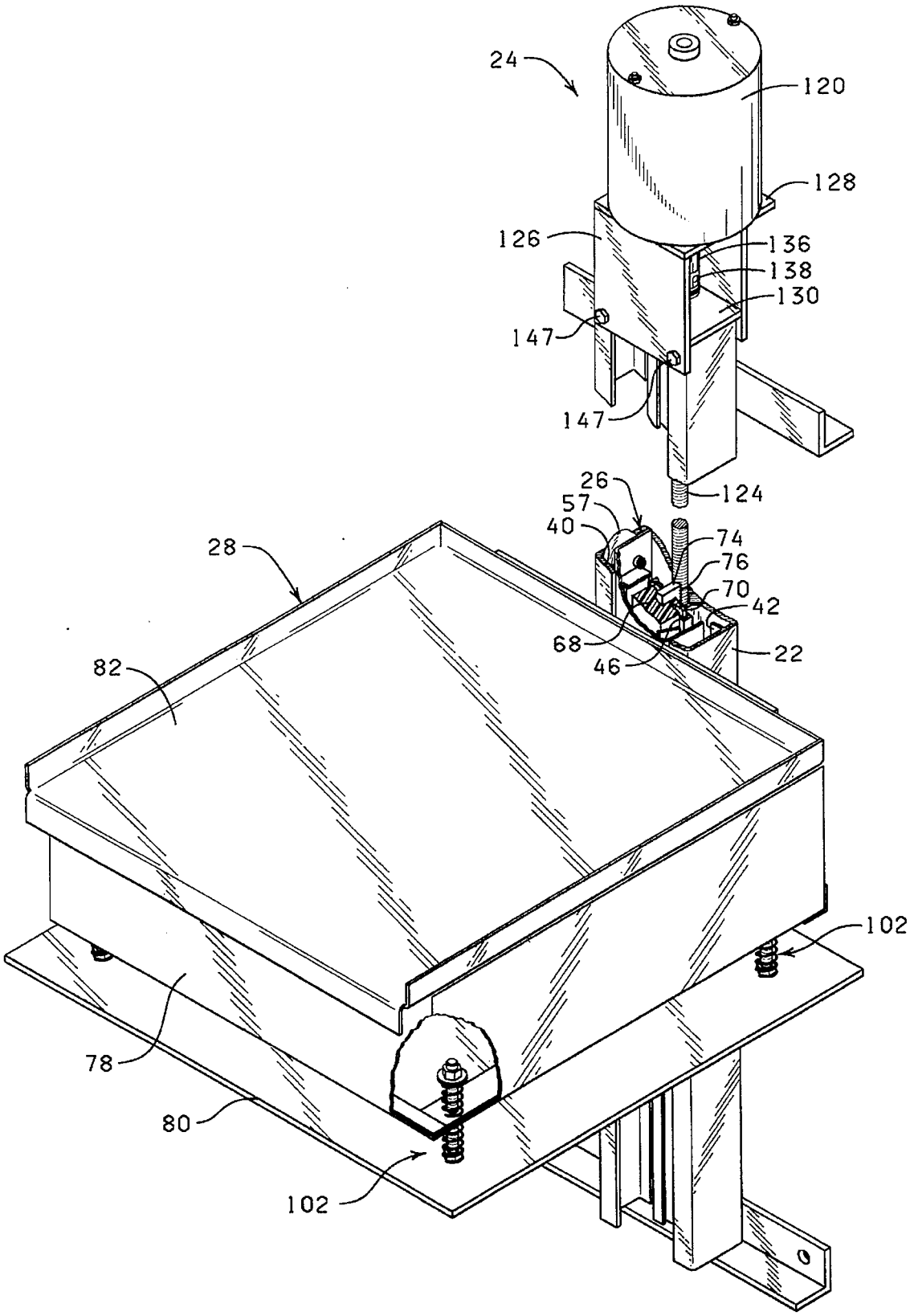
FIG. 5 is a partial cut away, perspective view of the lift assembly of the present invention.
Figure 5:
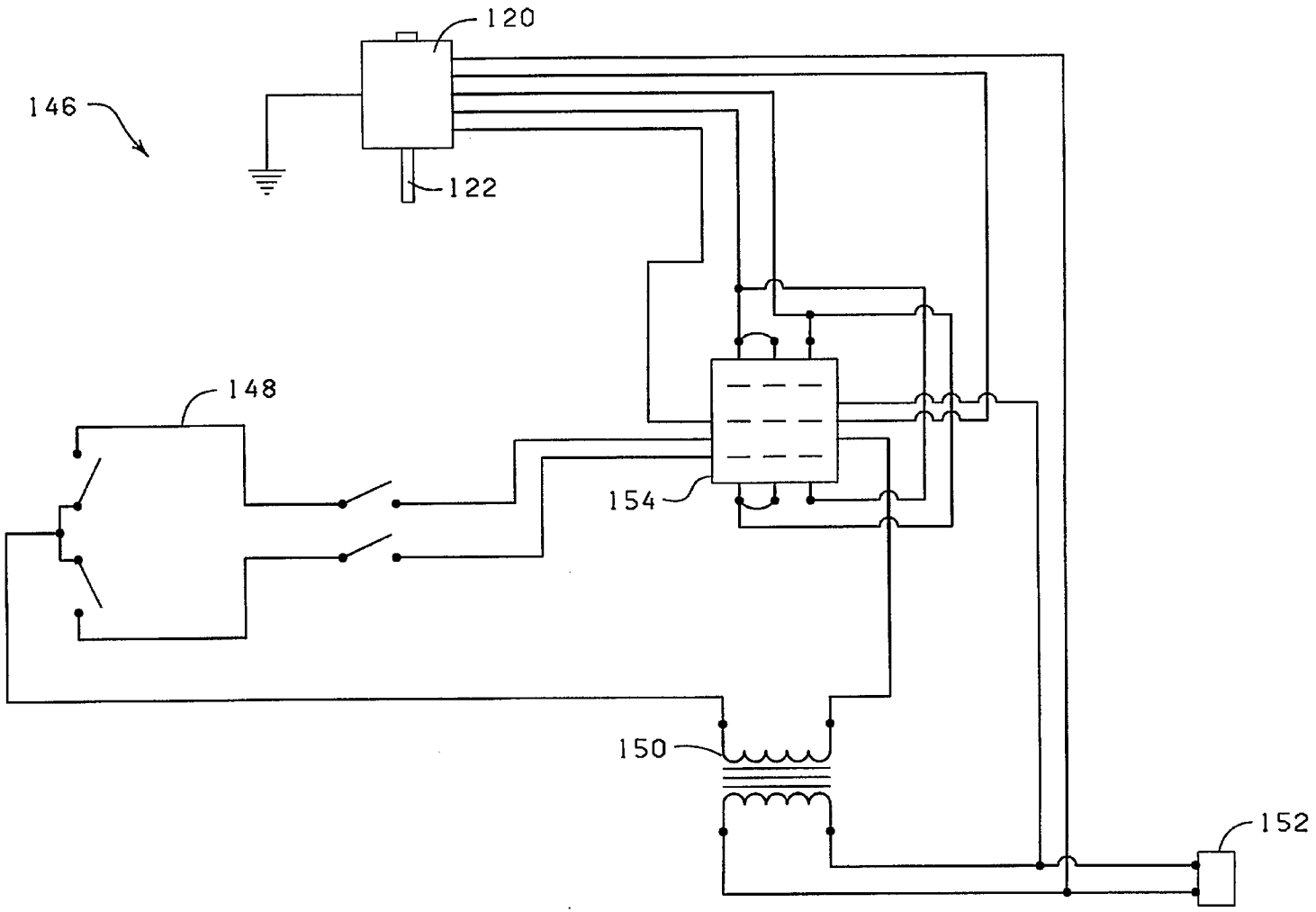

As shown in FIGS. 4 and 5, the carrier assembly 28 includes a support frame 78, a base plate 80, and a load platform 82. The support frame 78 comprises a U-shaped support member 84 which includes a first side 85, a second side 86 and a front side 87. A center support member 88 is perpendicularly connected to the front side 87 of the U-shaped support member 84 such that the center support member 88 is positioned between the first side 85 and the second side 86 in a parallel relation. A support bracket 92 is connected to the end of the first, second, and center support members 85, 86 and 88. The support frame 78 of the carrier assembly 28 is connected to the traveler assembly 26 via the brackets 67 and 69 in a conventional manner, such as by welding.

The load platform 82 is a relatively flat, square or rectangular plate provided with three up-turned edges 94, 96, and 98 which serve to aid in retaining the object 19 on the load platform 82 during use of the lifting assembly 10, and the load platform 82 is provided with a down-turned edge 100 which facilitates the loading of the object 19 onto the load platform 82 and the unloading of the object 19 from the load platform 82. The load platform 82 is connected to the support frame 78 such that the down-turned edge 100 is positioned away from the traveler assembly 26.

The assembly of the support frame 78 and the load platform 82 is resiliently connected to the base plate 80 with a plurality of spring assemblies 102 (only one spring assembly being illustrated in FIG. 3). Each spring assembly 102 includes a carriage bolt 104 with a threaded shaft 106. The threaded shaft 106 extends through a hole 108 formed in the base plate 80, and the bolt 104 is secured to the base plate 80 by a nut 109. A first spring 110 is disposed over the threaded shaft 106 and the threaded shaft 106 is then disposed through a hole 112 provided in the first side 85 of the support member 84. The threaded shaft 106 extends a distance above the hole 112, and the hole 112 is sized to allow the threaded shaft 106 to slide freely within the hole 112. A second spring 114 is disposed over the threaded shaft 106 and secured by a washer 116 and a nut 118.

Use of the spring assemblies 102 to connect the base plate 80 to the support frame 78 results in the base plate 80 being resiliently connected to the support frame 78. Such a resilient connection aids in the operation of the lift assembly 10 as will be described below.

The load platform 82 and the support frame 78 are both dimensioned to fit freely through the opening 20 in the second floor 16. However, the base plate 80 of the carrier assembly 28 is dimensioned so that the base plate 80 will not fit within the opening 20 in the second floor 16. More specifically, the base plate 80 is dimensioned such that the outer peripheral portion of the base plate 80 is engageable with the lower portion of the second floor 16 so as to indicate to an operator when the carrier assembly 28 is properly positioned within the opening 20 in the second floor 16.

As shown in FIG. 5, the traveler assembly 26 is slidingly disposed in the guide rail 22 with the wheels 57 and 62 positioned in the wheel guide 40 of the guide rail 22 and the wheels 58 and 64 positioned in the wheel guide 42 of the guide rail 22. The traveler guide portion 70 of the guide block 68 is slidably disposed in the traveler slot 46 with the threaded edge 76 of the gear block 74 extended into the threaded bore 44 of the guide rail 22.

The drive assembly 24, best illustrated in FIGS. 2 and 5, is connected to the second end 32 of the guide rail 22 and is provided to mechanically move the traveler assembly 26 and the carrier assembly 28 between an up position and a down position. The drive assembly 24 includes a motor 120 having a drive shaft 122 (FIG. 2) with a lift screw 124 connected thereto and extending from the second end 32 of the guide rail 22 to the first end 30 of the guide rail 22. The lift screw 124 is disposed in the bore 44 of the guide rail such that the lift screw 124 matingly engages the threaded edge 76 of the gear block 74. Satisfactory results have been achieved wherein the motor 120 is a ½ horsepower, 1,750 rpm DC reversible drive electric motor, but any other sufficient motor can be used to power the lift screw 124.

The drive assembly 24 further includes an interface block 126 having a motor mounting plate 128 positioned generally above a support plate 130. The motor 120 is mounted on the motor mounting plate 128 so that a portion of the drive shaft 122 extends through an aperture 132 formed through the motor mounting plate 128. The aperture 132 is sized to permit the drive shaft 122 of the motor 120 to freely turn within the aperture 132.

The support plate 130 of the interface block 126 has an aperture 134 formed therein and sized to rotatably receive the lift screw 124. The aperture 132 of the motor mounting plate 128 is generally vertically aligned with the aperture 134 of the support plate 130. The drive shaft 122 of the motor 120 is preferably connected to the lift screw 124 by a drive shaft coupling 136, a screw coupling 138, a locking collar 140, a pair of thrust washers 142 and a roller bearing 144. It will be appreciated, however, that the drive shaft 122 and the lift screw 124 can be connected in any suitable manner. The interface block 126 is connected to the second end 32 of the guide rail 22 by aligning a plurality of holes 145 provided in the interface block 126 with the holes 48 of the guide rail 22 and securing the interface block 126 to the guide rail 22 with a plurality of bolts 147.

Referring now to FIGS. 1 and 6, the lift assembly 10 further includes a drive control assembly 146 for operating the drive assembly 24. The drive control assembly 146 includes a switch 148 with an "up" position, a "down" position, and an "off" position. The drive control assembly 146 provides reversible phase DC electric power to the electric motor 120. When the switch 148 is positioned in the "up" position, DC power is provided to the motor 120 such that the drive shaft 122 turns in a clockwise direction. When the switch 148 is placed in the "down" position, electric power is provided to the motor 120 in such a manner that the drive shaft 122 turns in a counterclockwise direction. Electric power to the motor 120 is interrupted when the switch is placed in the "off" position.

The switch 148 is connected to and is interposed between the motor 120 and a transformer 150. The transformer 150 is in turn connected to a power source 152. The power source 152 typically provides 120 volt, 20 ampere AC current, which is transformed to the appropriate voltage and amperage by the transformer 150.

A relay 154 is connected to and interposed between the motor 120 and the switch 148. The relay provides reverse phase DC current to the motor 120. It is understood that the drive control assembly 146 includes diodes, diode arrays, or other conventional devices suitable for converting AC electric current provided by the power source 152 to DC electric current suitable for use by the motor 120.

In operation, with the traveler assembly 26 and the carrier assembly 28 located on the first floor 14, the object 19 to be moved to the second floor 16 is disposed on the load platform 82. An operator then moves the switch 148 to the "up" position which in turn causes the lift screw 124 to rotate in a clockwise direction. The mating engagement between the threads of the lift screw 124, the threaded edge 76 of the gear block 74 of the traveler assembly 26 causes the traveler assembly 26 and the carrier assembly 28, to move in an upward direction 156 (FIG. 1). As the traveler assembly 26 moves up the guide rail 22, the traveler guide portion 70 slides through the traveler slot 44 of the guide rail 22 and the wheels 54 and 62 roll along the wheel guide 40 and the wheels 58 and 64 rollingly engage the guide rail 22 within the wheel guide 42, thereby guiding the traveler assembly 26 up the guide rail 22.

The traveler assembly 26 and the carrier assembly 28 continue in the upward direction 156 until the load platform 82 and the support frame 78 pass through the opening 20 in the second floor 16 and the outer peripheral portion of the base plate 80 engages the ceiling or lower portion of the second floor 16. Because of the resilient connection between the base plate 80 and the support frame 78, the impact of the carrier assembly 28 with the second floor 16 is cushioned thereby providing the operator an opportunity to move the switch 148 to the "off" position. With the switch 148 in the "off" position, the movement of the traveler assembly 26 and the carrier assembly 28 is arrested with the load platform 82 substantially level with the upper portion of the second floor 16. The objects 19 on the load platform 82 is then removed from the load platform 82.

To move the object 19 from the second floor 16 to the first floor 14, the switch 148 is moved to the "down" position thereby causing the lift screw 124 to rotate in a counter-clockwise direction and cooperate with the threaded edge 76 of the gear block 74 of the traveler assembly 26 to move the traveler assembly 26 and the carrier assembly 28 in a downward direction 158. The traveler assembly 26 and the carrier assembly 28 move in the downward direction 158 until the base plate 80 makes contact with the first floor 14 at which time the operator moves the switch to the "off" position.

From the above description it is clear that the present invention is well adapted to carry out the objects and to attain the advantages mentioned herein as well as those inherent in the invention. While a presently preferred embodiment of the invention has been described for purposes of this disclosure, it will be understood that numerous changes may be made which will readily suggest themselves to those skilled in the art and which are accomplished within the spirit of the invention disclosed and as defined in the appended claims.

What is claimed is:

1. A lift assembly for moving an object between a first vertical position and a second vertical position, the lift assembly comprising:

a guide rail having a first end adapted to be positioned near the first vertical position and a second end adapted to be positioned near the second vertical position, the guide rail having a bore extending from the first end to the second end thereof, a traveler slot extending from the first end to the second end thereof, and a pair of wheel guides extending from the first end to the second end thereof;

traveler means slidingly engaged with the guide rail for selective movement along the guide rail between the first vertical position and the second vertical position, the traveler means comprising:

a body member slidingly disposed in the guide rail;

a first wheel connected to the body member so as to be rollingly engaged with the guide rail within one of the wheel guides;

a second wheel connected to the body member so as to be rollingly engaged with the guide rail within the other wheel guide of the guide rail;

a guide block connected to the body member of the traveler means, the guide block having a traveler guide portion slidingly disposed in the traveler slot of the guide rail; and a gear block extending from the guide block and into the bore of the guide rail, the guide block having a threaded edge;

carrier means connected to the traveler means for carrying the object as the traveler means moves between the first vertical position and the second vertical position; and drive means matingly engaged with the traveler means for selectively moving the traveler means between the first vertical position and the second vertical position, the drive means comprising:

a lift screw rotatably disposed in the bore of the guide rail, the lift screw matingly engaged with the threaded edge of the gear block to move the traveler means in an upward direction when the lift screw is rotated in a first direction and in a downward direction when the lift screw is rotated in a second direction;

a motor operably connected to the lift screw such that the lift screw is rotatable in the first direction and the second direction;

a power source; and a switch interposed between the power source and the motor, the switch being positionable in a first closed position such that electrical continuity is established between the power source and the motor to rotate the lift screw in the first direction, the switch being positionable in a second closed position such that electrical continuity is established between the power source and the motor to rotate the lift screw in the second direction, and the switch being positionable in an open position such that electrical continuity is interrupted between the power source and the motor.

2. The lift assembly of claim 1 wherein the carrier means comprises:

a support frame having an upper end, a lower end, a first side, a second side, a front side, and a back side, the support frame being connected to the body member of the traveler means; and a load platform connected to the upper end of the support frame.

3. The lift assembly of claim 2 wherein the carrier means further comprises:

a base plate resiliently connected to the lower end of the support frame.

4. The lift assembly of claim 3 wherein the first vertical position is a first floor and the second vertical position is an adjacent second floor of a structure, and wherein the guide rail is extendable from the first floor to the second floor through an opening provided in the second floor.

5. The lift assembly of claim 4 wherein the support frame and the load platform are dimensioned to pass through the opening in the second floor and wherein the base plate is dimensioned such that an outer peripheral portion of the base plate engages the second floor as the traveler means moves in the upward direction.

6. A lift assembly for moving an object between a first floor and a second floor of a structure wherein the second floor of the structure is provided with an opening, the lift assembly comprising:

a guide rail having a first end mounted to the structure near the first floor thereof and a second end mounted to the structure near the second floor thereof such that the guide rail extends through the opening in the second floor of the structure, the guide rail having 2;

traveler means slidingly engaged with the guide rail for selective movement along the guide rail between the first floor and the second floor, the traveler means comprising:

a body member slidingly disposed in the guide rail;

a first wheel connected to the body member so as to be rollingly engaged with the guide rail within one of the wheel guides; and a second wheel connected to the body member so as to be rollingly engaged with the guide rail within the other wheel guide of the guide rail a guide block connected to the body member of the traveler means, the guide block having a traveler guide portion slidingly disposed in the traveler slot of the guide rail; and a gear block extending from the guide block and into the bore of the guide rail, the guide block having a threaded edge;

carrier means connected to the traveler means for carrying the object as the traveler means moves between the first floor and the second floor; and drive means matingly engaged with the traveler means for selectively moving the traveler means between the first floor and the second floor, the drive means comprising:

a lift screw rotatably disposed in the bore of the guide rail, the lift screw matingly engaged with the threaded edge of the gear block to move the traveler means in an upward direction when the lift screw is rotated in a first direction and in a downward direction when the lift screw is rotated in a second direction;

a motor operably connected to the lift screw such that the lift screw is rotatable in the first direction and the second direction;

a power source; and a switch interposed between the power source and the motor, the switch being positionable in a first closed position such that electrical continuity is established between the power source and the motor to rotate the lift screw in the first direction, the switch being positionable in a second closed position such that electrical continuity is established between the power source and the motor to rotate the lift screw in the second direction, and the switch being positionable in an open position such that electrical continuity is interrupted between the power source and the motor.

7. The lift assembly of claim 6 wherein the carrier means comprises:

a support frame having an upper end, a lower end, a first side, a second side, a front side, and a back side, the support frame being connected to the body member of the traveler means; and a load platform connected to the upper end of the support frame.

8. The lift assembly of claim 7 wherein the carrier means further comprises:

a base plate resiliently connected to the lower end of the support frame.

9. The lift assembly of claim 8 wherein the support frame and the load platform are dimensioned to pass through the opening in the second floor and wherein the base plate is dimensioned such that an outer peripheral portion of the base plate engages the second floor as the traveler means moves in the upward direction.

10. A lift assembly for moving an object between a first vertical position and a second vertical position, the lift assembly comprising:

a guide rail having a first end adapted to be positioned near the first vertical position and a second end adapted to be positioned near the second vertical position, the guide rail having a bore, a traveler slot, and a pair of wheel guides;

a body member slidingly disposed in the guide rail;

a first wheel connected to the body member so as to be rollingly engaged with the guide rail within one of the wheel guides;

a second wheel connected to the body member so as to be rollingly engaged with the guide rail within the other wheel guide of the guide rail;

a guide block connected to the body member of the traveler means, the guide block having a traveler guide portion slidingly disposed in the traveler slot of the guide rail; and a gear block extending from the guide block and into the bore of the guide rail, the guide block having a threaded edge;

carrier means connected to the body member for carrying the object as the traveler means moves between the first vertical position and the second vertical position;

a lift screw rotatably disposed in the bore of the guide rail, the lift screw matingly engaged with the threaded edge of the gear block to move the gear block in an upward direction when the lift screw is rotated in a first direction and in a downward direction when the lift screw is rotated in a second direction; and means for rotating the lift screw in the first direction and in the second direction.

11. The lift assembly of claim 10 wherein the first vertical position is a first floor and the second vertical position is an adjacent second floor of a structure, and wherein the guide rail is extendable from the first floor to the second floor through an opening provided in the second floor.

12. The lift assembly of claim 11 wherein the carrier means comprises:

a support frame having an upper end and a lower end, the support frame connected to the body member;

a load platform connected to the upper end of the support frame; and a base plate resiliently connected to the lower end of the support frame, wherein the support frame and the load platform are dimensioned to pass through the opening in the second floor of the structure and the base plate is dimensioned to engage the second floor of the structure.

* * * * *